US005697668A

United States Patent [19]

Chao

[11] Patent Number: 5,697,668

[45] Date of Patent: Dec. 16, 1997

[54] RENOVATED STRUCTURE FOR AN ADJUSTABLE DESK CHAIR

[76] Inventor: Chuan-Pao Chao, 1st Fl., No. 16, Lane 247, Sec. 2, Chien-Kang Rd, Tainan, Taiwan

[21] Appl. No.: 743,235

[22] Filed: Nov. 5, 1996

[51] Int. Cl.[6] ..... A47B 39/00

[52] U.S. Cl. ..... 297/172; 297/135; 297/160

[58] Field of Search ..... 297/172, 135, 297/160, 174

[56] References Cited

U.S. PATENT DOCUMENTS

| | | | |
|---|---|---|---|
| 1,884,497 | 10/1932 | Abbott | 297/172 X |
| 2,894,561 | 7/1959 | Mackintosh | 297/172 |
| 5,054,852 | 10/1991 | Tholkes | 297/172 |

FOREIGN PATENT DOCUMENTS

| | | | |
|---|---|---|---|
| 494537 | 7/1953 | Canada | 297/172 |
| 432257 | 12/1911 | France | 297/172 |
| 1065264 | 5/1954 | France | 297/172 |
| 63020 | 7/1955 | France | 297/172 |
| 1001 | of 1903 | United Kingdom | 297/172 |

*Primary Examiner*—Laurie K. Cranmer

*Attorney, Agent, or Firm*—Morton J. Rosenberg; David I. Klein

[57] ABSTRACT

A renovated structure for an adjustable desk chair comprises a base frame, a front and a rear sliding thimbles and two bolts, in which a tabletop support and a seat support are joined together on the top end of the base frame and the ends of both are separated, two grip slides are inserted in the tabletop support and the seat support, respectively, cooperating to two bolts, to fasten the front and the rear sliding thimbles on the tabletop support and the seat support respectively by passing said bolts through the through-hole on the sliding thimbles and the slotted holes on the supports to bolt in said grip slides. In practicing, loosen the bolts, the front and the rear sliding thimbles can slide up-down along the supports separately to adjust the heights of the tabletop and the seat and the space between them to suit a wide variety of builds of the users.

1 Claim, 10 Drawing Sheets

RENOVATED STRUCTURE FOR AN ADJUSTABLE DESK CHAIR

BACKGROUND OF THE INVENTION (1) Field of the Invention

The present invention relates to an adjustable desk chair, and more particularly to a desk and chair which desk height and space are adjustable.

(2) Description of the Prior Art

In accordance with the desk and chair in classrooms or in lecture rooms, the desks and chairs are mostly categorized in two types which are separated type and coupled type. The separated type is generally made of wood material with the space between the desk and chair adjustable, but the heights of the tabletop and the chair are not adjustable. Whereas the coupled type, as shown in FIG. 6, is mostly made of metallic frame which links the table and the chair together which heights of the desk and the chair and the space in-between are fixed without adjustable. It is obvious from the above-description that a well arrangement and adjustment of the space between them is a contradictory, and the primary shortcoming of prior art is that the heights of the desk and the chair are not adjustable so that they can not fit to a wide variety of users such as the college students.

OBJECTS AND SUMMARY OF THE INVENTION

In accordance with the above-mentioned shortcomings of the prior art, it is a main object of the present invention to provide an adjustable couple desk chair for a variety of consumers in that the heights of and the space between the desk and the chair can be adjusted in order to suit to a wide variety of users.

In order to meet the object, the present invention includes a H-shaped base frame with two sockets on respective ends of the middle rod for a tabletop support and a seat support secure therein respectively. The tabletop support is plugged into and fixed in the front socket vertically and the upper section is formed with an inclining section towards the front position and a slotted hole at the far end which is adapted for a bolt to insert therethrough for securing a L-shaped front sliding thimble on a proper position of the upper section of the tabletop support cooperating with a grip slide in the inside of the tabletop support, and a tabletop is fixed on the top of said L-shaped front sliding thimble. In the same way, said seat support is a straight thimble plugged and fixed into the rear socket in a slanting manner, a slotted hole is formed on the upper section for a bolt passing through to secure a L-shaped rear sliding thimble on cooperating with a grip slide in the inside of the seat support, and a seat is fixed on the top of the rear sliding thimble. In practicing, when the bolts is loosen, the front and the rear sliding thimbles can slide on the upper sections of the tabletop and the seat supports respectively to change the heights of the tabletop and the seat and the space between them.

DETAILED DESCRIPTION OF PREFERRED EMBODIMENTS

Figure 1:
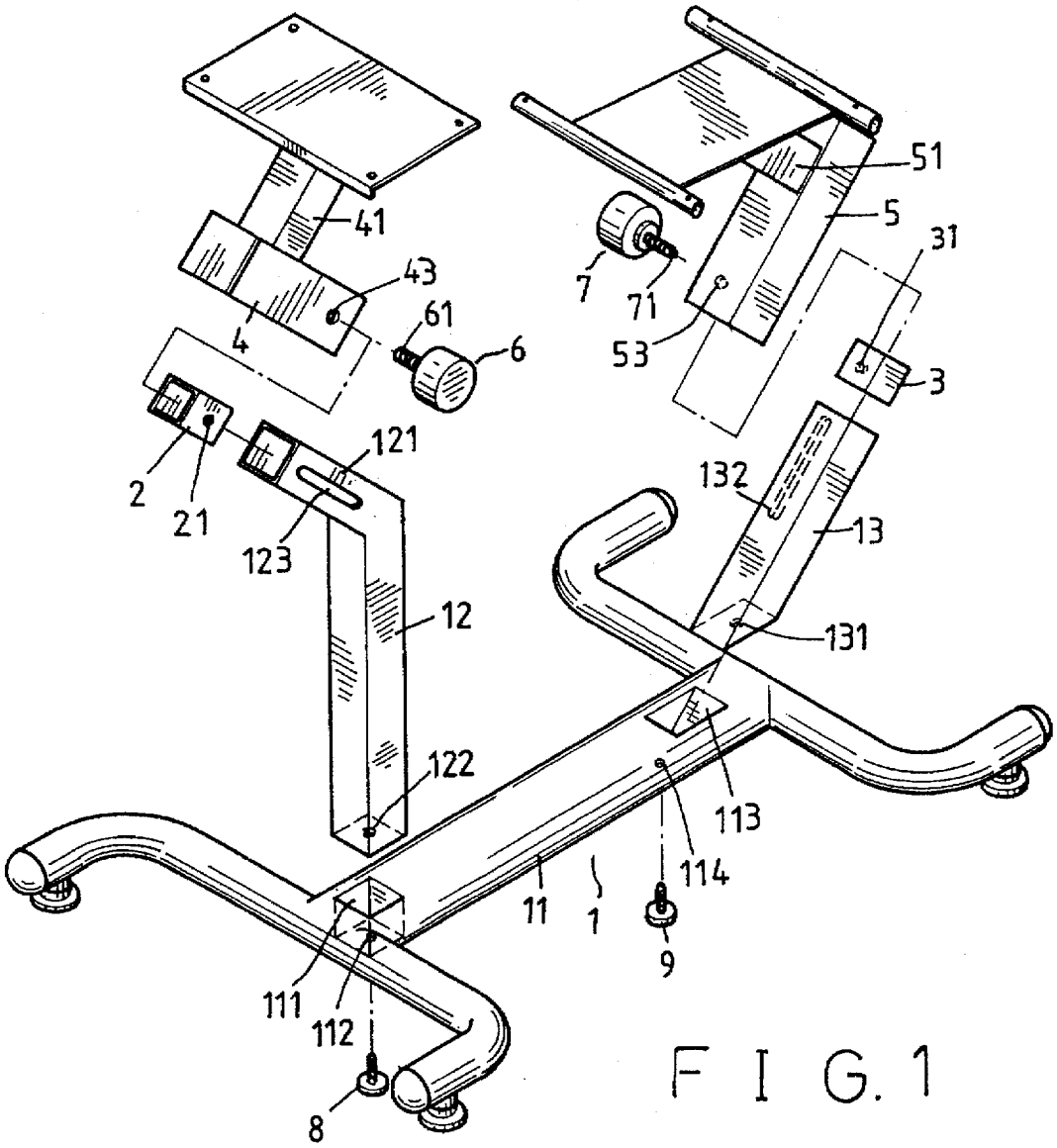
FIG. 1 is an exploded view of the present invention.

Referring to FIG. 1, the present invention includes a H-shaped base frame 1, two grip slides 2 3, a front and a rear sliding thimbles 4 and 5 and several bolts 6, 7, 8 and 9. The H-shaped base frame 1 comprises a middle member 11 having a first socket 111 at one end with a through-hole 112 at the bottom interconnecting with the socket 111 for securing a tabletop support 12 thereat, and a second socket 113 at the other end thereof opposing the first socket 111, having also a through-hole 114 at the bottom interconnecting with the second socket 113 for securing a seat support 13 thereat. The upper section of the tabletop support 12 inclines towards the front direction to form a telescope joint segment 121, and a slant socket 113 on the top end, and the upper section of the seat support 13 inclines rearwardly. Both of the tabletop support 12 and the seat support 13 have a blind bottom end with a bolting hole 122 and 131 respectively. The telescope joint segment 121 on the tabletop support 12 and the seat support 13 have a slotted holes 123 132 at one side respectively.

The grip slides 2 and 3 are adapted to be inserted into the telescope joint segment 121 and the seat support 13 respectively, each of which has a threaded hole 21 and 31 at both sides corresponding to the slotted hole 123 132.

The top ends of the front and the rear L-shaped sliding thimbles 4 5 comprise a tie members 41 and 51, respectively and are connected at their ends to the sliding thimbles 4 and 5 in a 90 degrees angle. Whereas the other ends of the tie members 41 and 51 are mounted to a tabletop 42 and a seat 52, respectively. The bottom ends of the front and the rear L-shaped sliding thimbles 4 and 5 are formed with a through-holes 43 and 53 and are corresponding to the slotted holes 123 and 132 of the telescope joint segment 121 and the seat support 13 when insertion therein.

The bolts 6 and 7 have a handle at an end respectively, the other ends of which are formed with slots 61 71 respectively for spreading the end to prevent the bolt from loosen from the grip slide 2 or 3.

Figure 2:
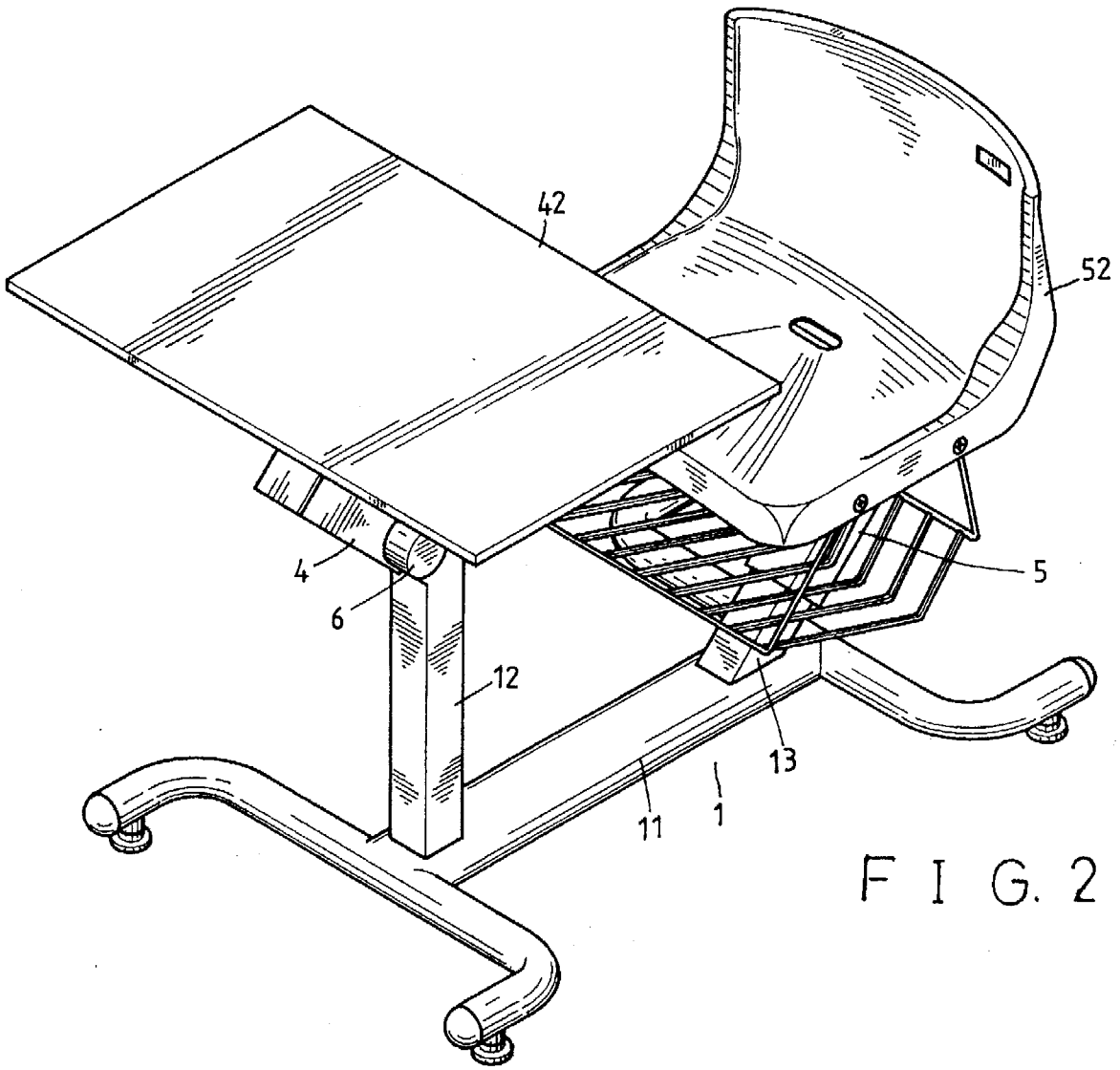
FIG. 2 is a solid view of the present invention.
Figure 3:
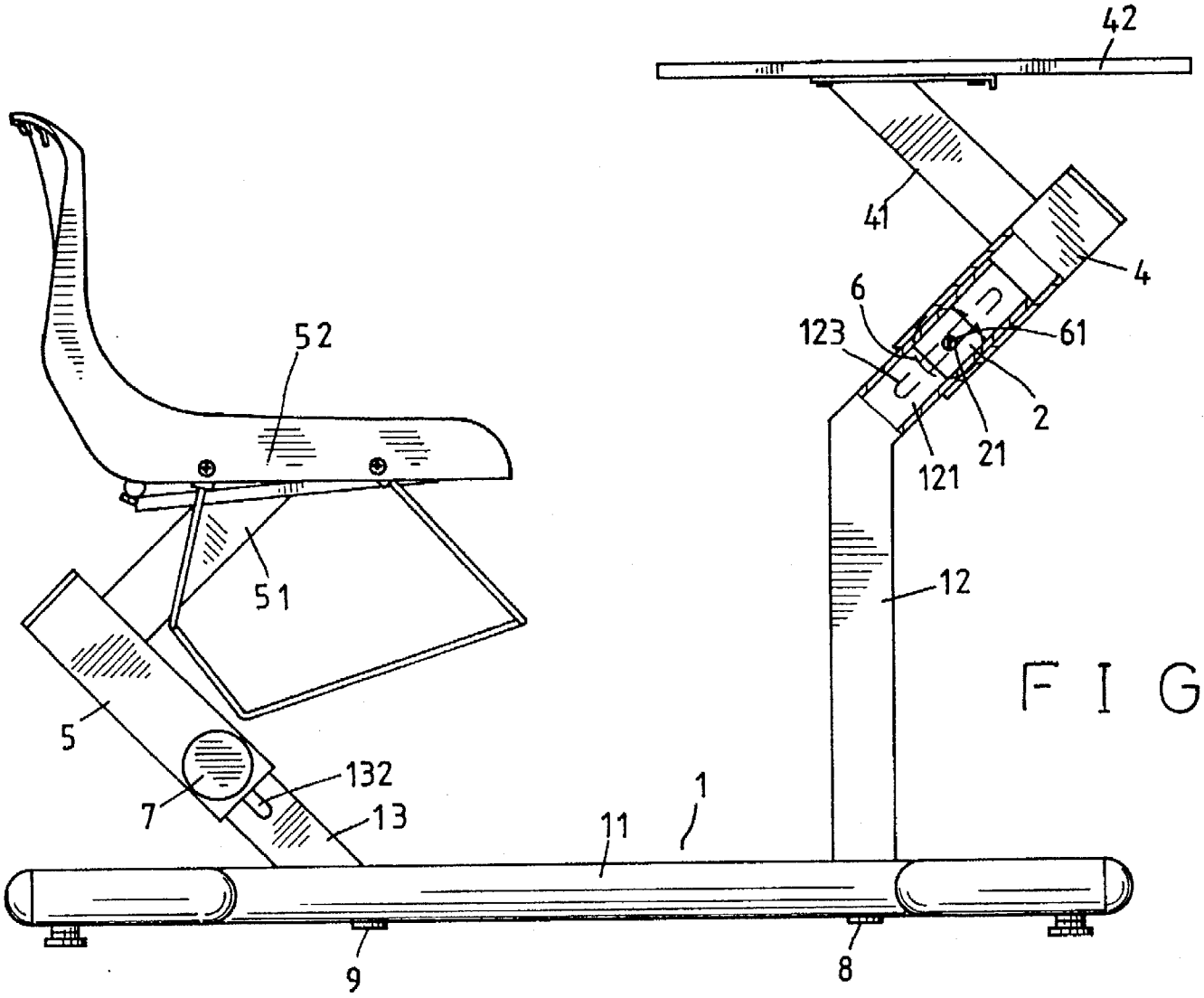
FIG. 3 is a side view of the present invention.

In combining, referring to FIG. 2 and FIG. 3, insert the table and the seat supports 12 13 into the slotted holes 111 and 112, respectively, and secured by bolts 8 and 9 through the through-holes 112 and 114. Inserting the grip slides 2 3 into the telescope joint segment 121 and the seat support 13 with the threaded holes 21 31 aligned with the slotted holes 121 and 132, respectively. Then sleeve the front and the rear L-shaped sliding thimbles 4 and 5 over the telescope joint segment 121 and the seat support 13 and thread the bolts 6 and 7 in via the through-holes 43 and 53 and the slotted holes 123 and 132 respectively. The ends of the bolts 6 and 7 in the grip slides 2 and 3 are spreaded by enlarging the slots 61 and 71 for retaining the bolts securely.

Figure 4:
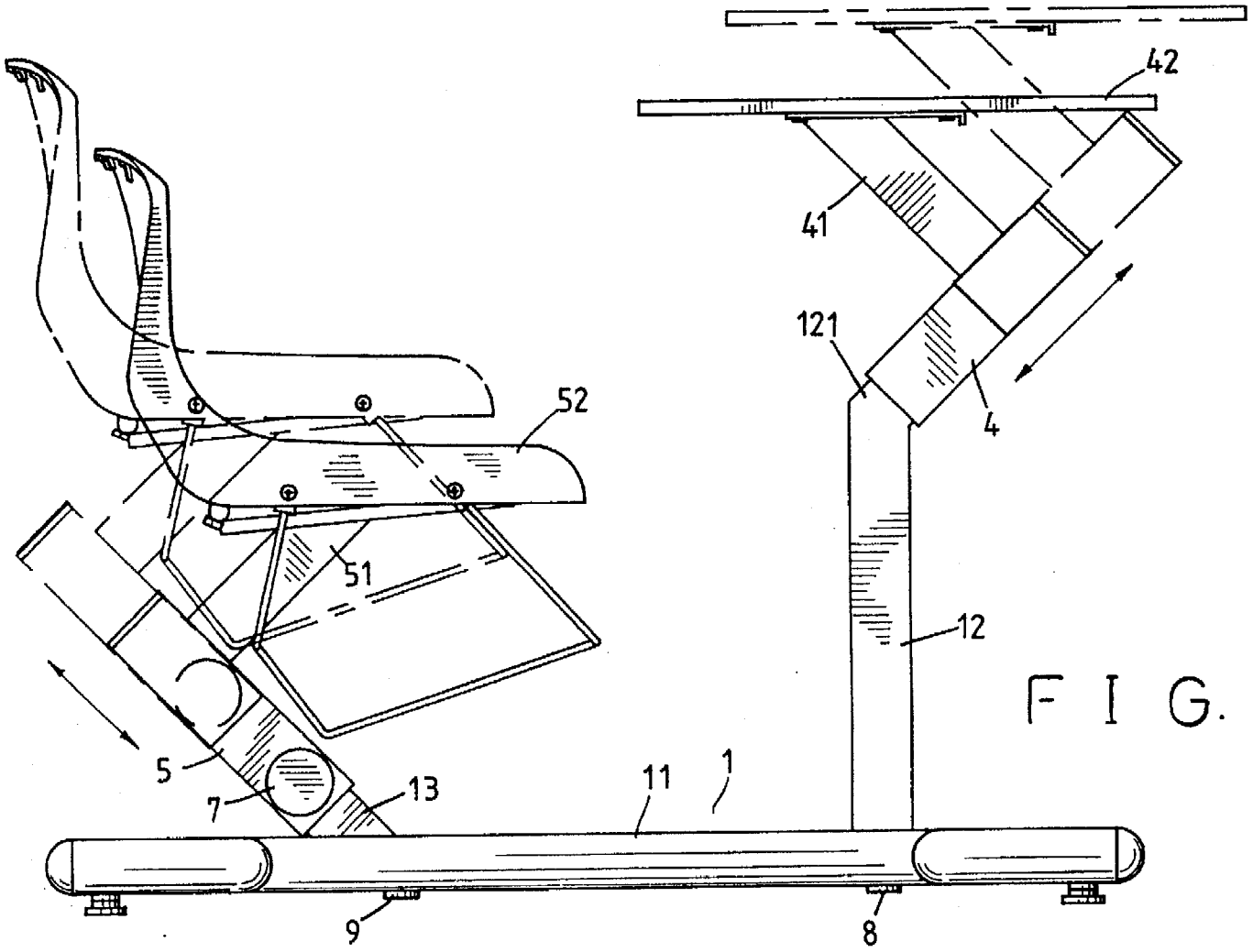
FIG. 4 is a side view showing the adjusting operation of the present invention.
Figure 4A:
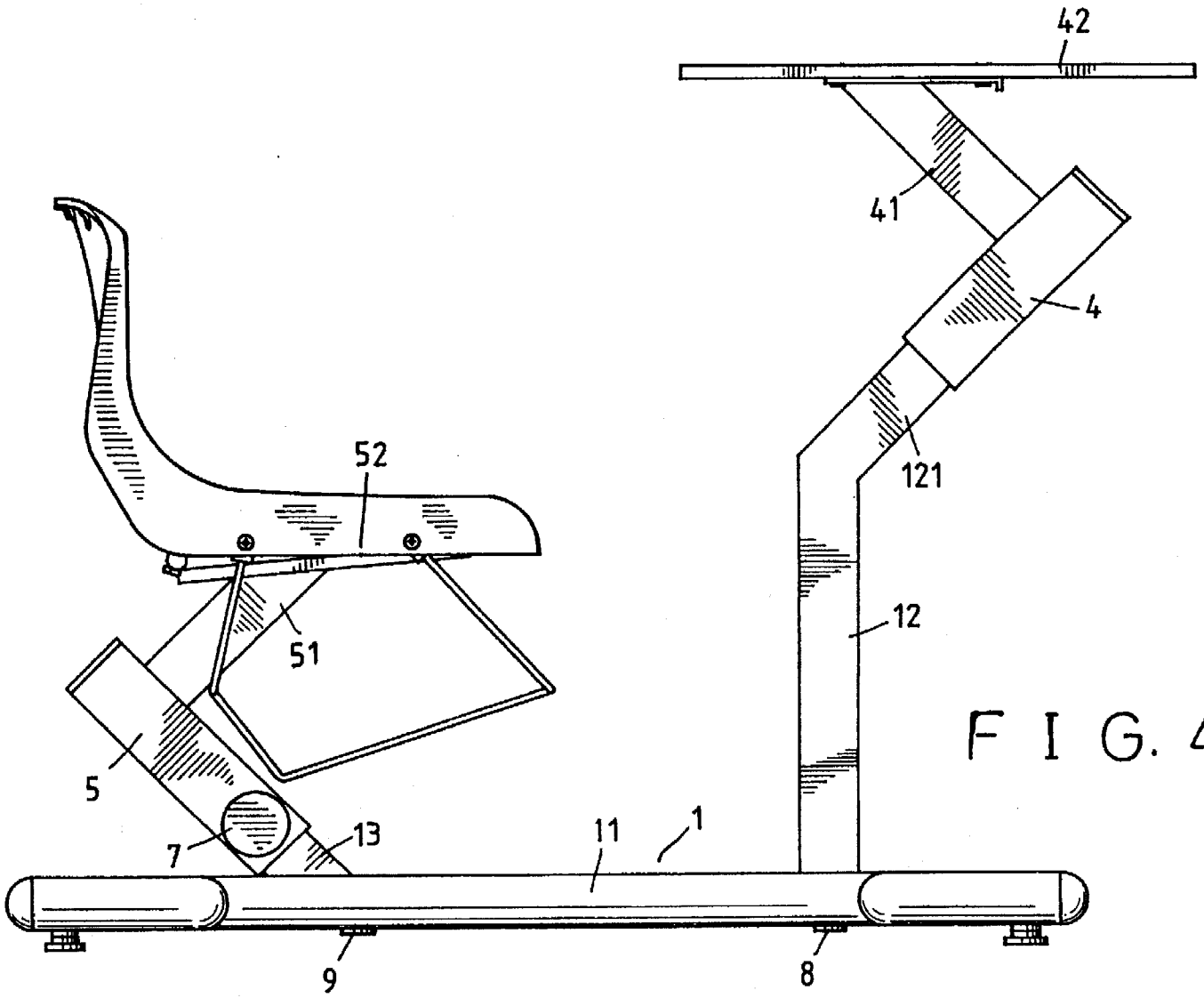
FIG. 4A is a side view showing the action one of the present invention.
Figure 4B:
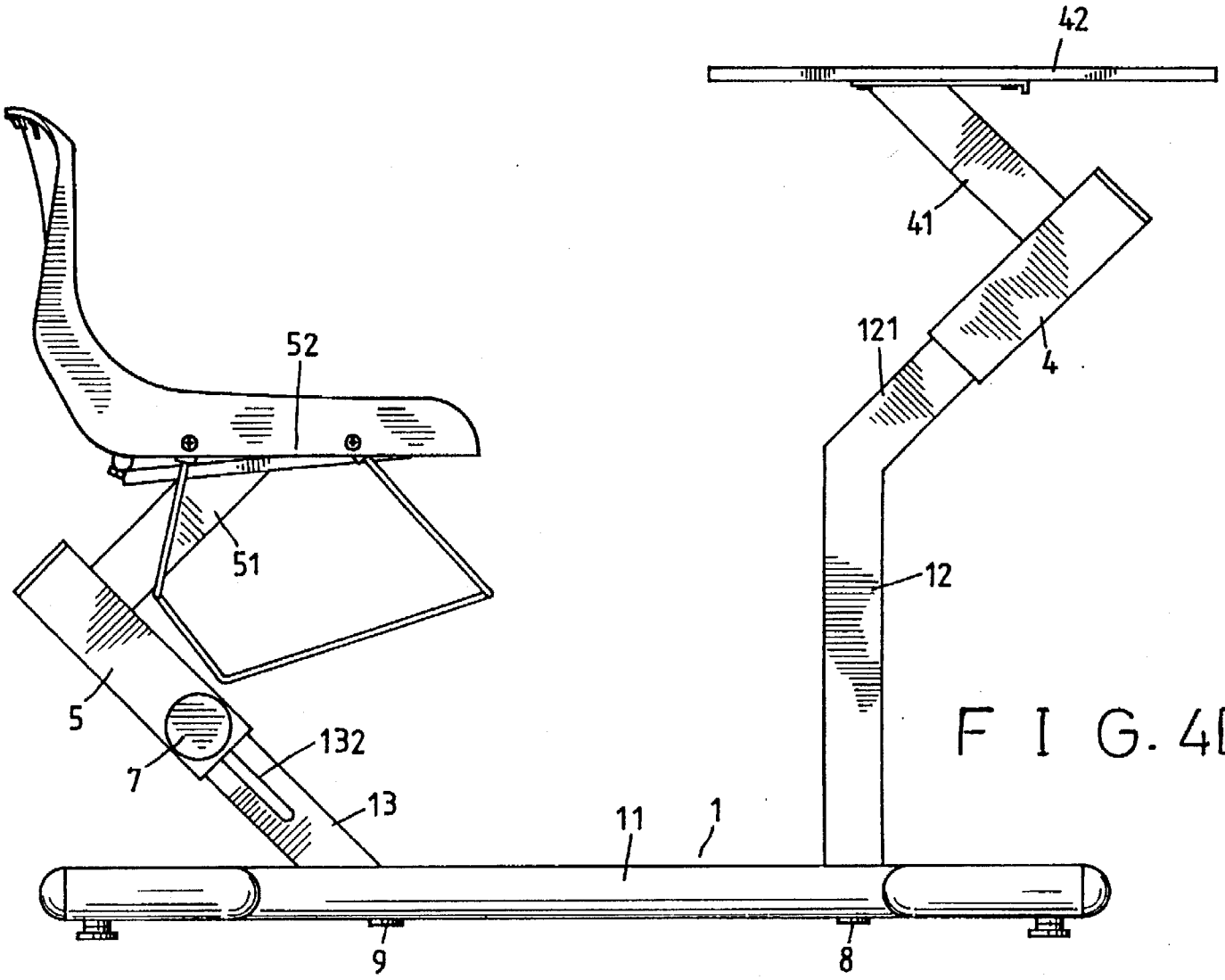
FIG. 4B is a side view showing the action two of the present invention.
Figure 4C:
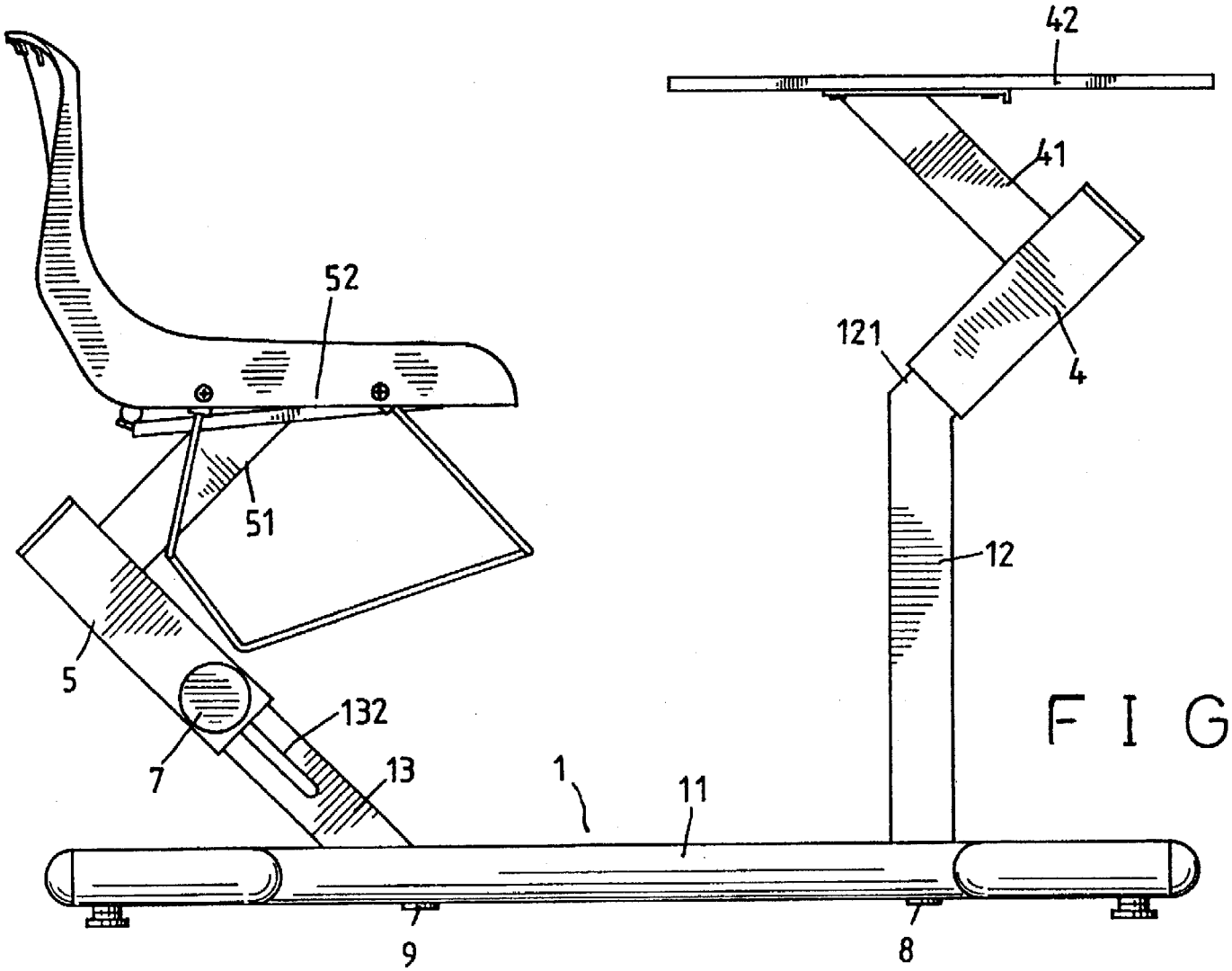
FIG. 4C is a side view showing the action three of the present invention.
Figure 4D:
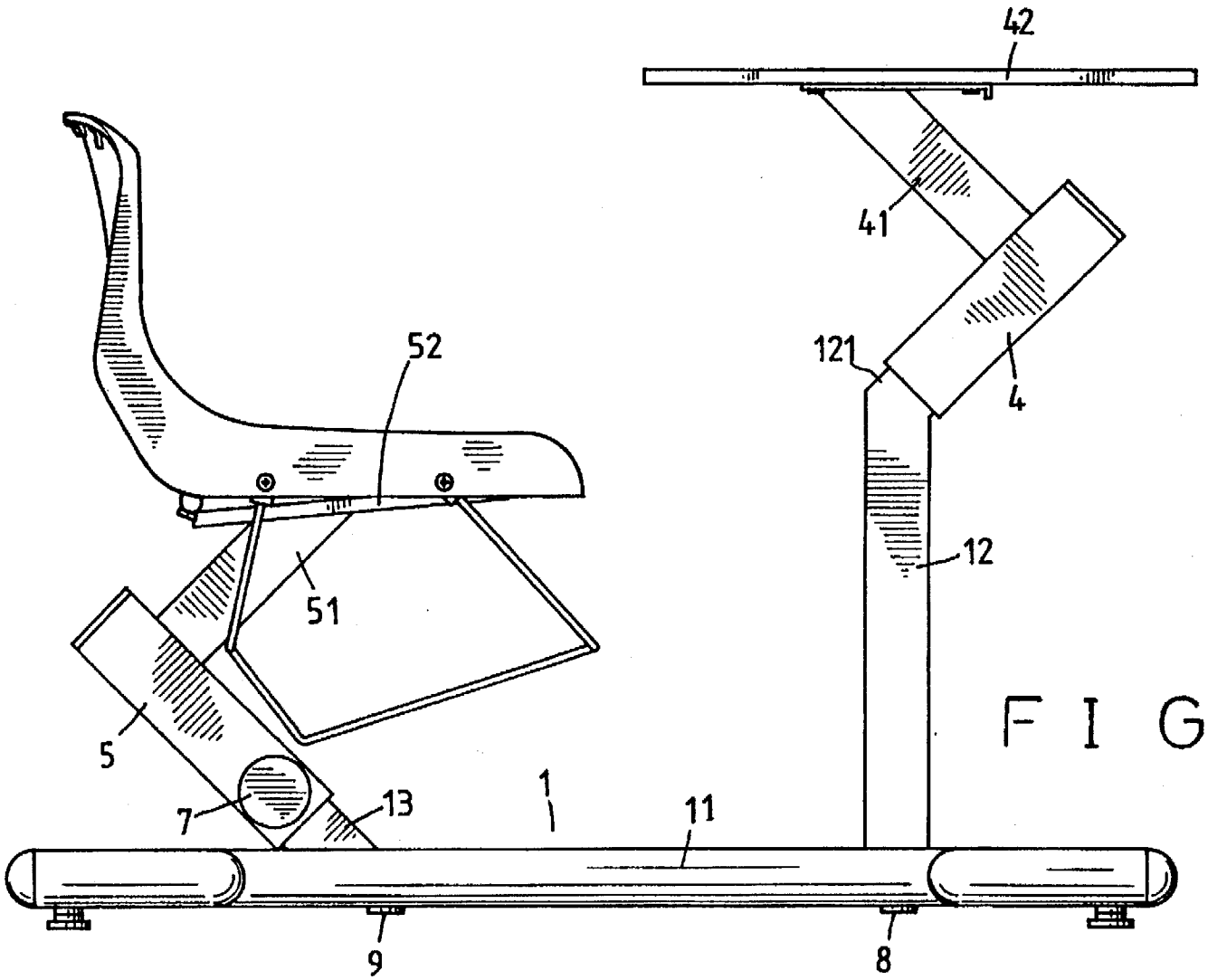
FIG. 4D is a side view showing the action four of the present invention.

In practicing, referring to FIG. 4, to adjust the height of the present invention, by lifting up the front sliding thimble 4 of the tabletop 12 and lowering down the rear sliding thimble 5 of the seat supports 13 for taller user, as shown in FIG. 4A or vise versa for a shorter user, as shown in FIG. 4B. On the other hand, if the user has a large body size, the front and the rear sliding thimbles 4 and 5 can both be drawn up to increase the space between the tabletop 42 and the seat 52, as shown in FIG. 4C. Conversely, as showing of FIG. 4D, when the front and the rear sliding thimbles 4 5 are sliding down together which reduces the space between to suit a skinny person.

Figure 5:
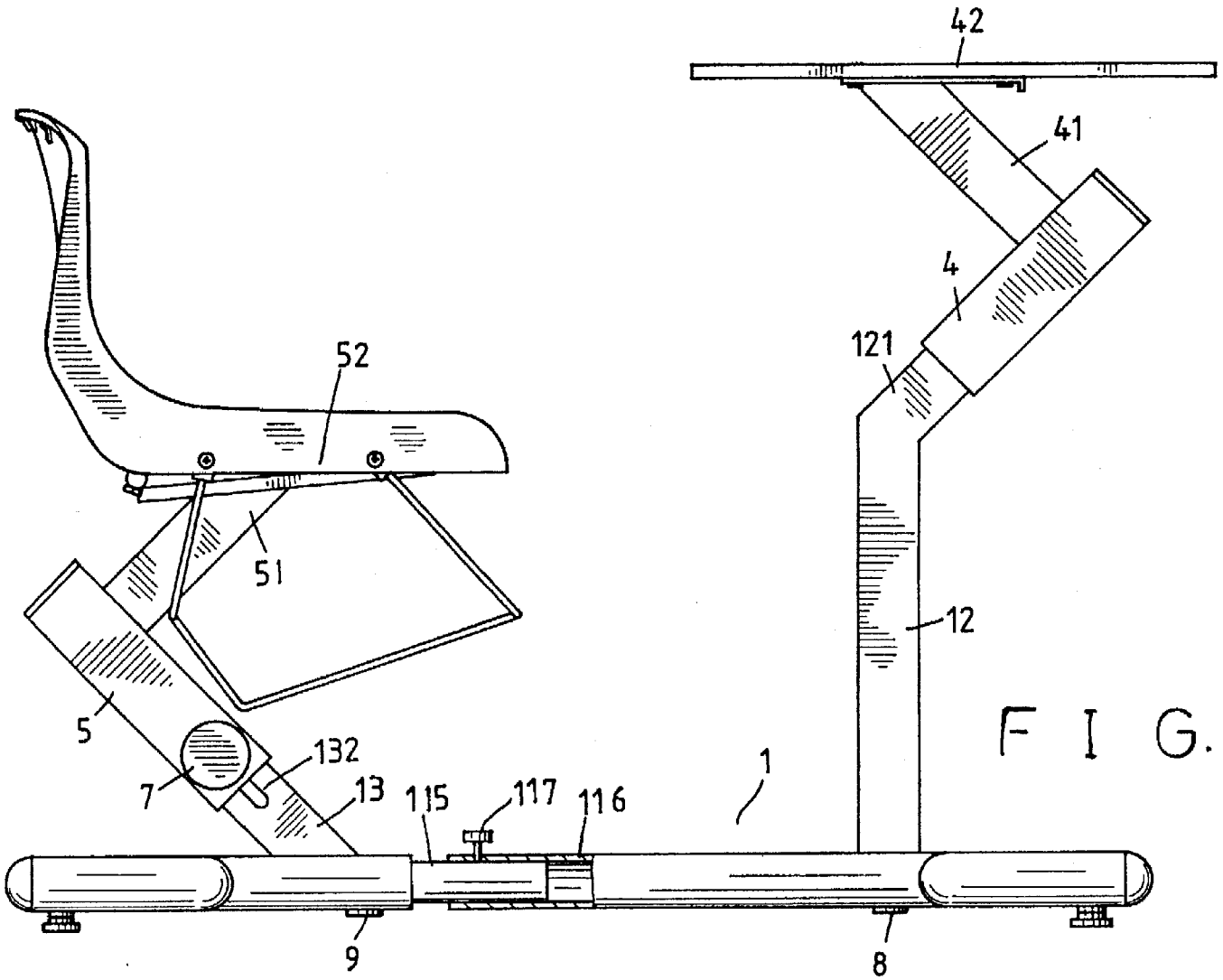
FIG. 5 is a side partial sectioned view of a second embodiment of the present invention.
Figure 6:
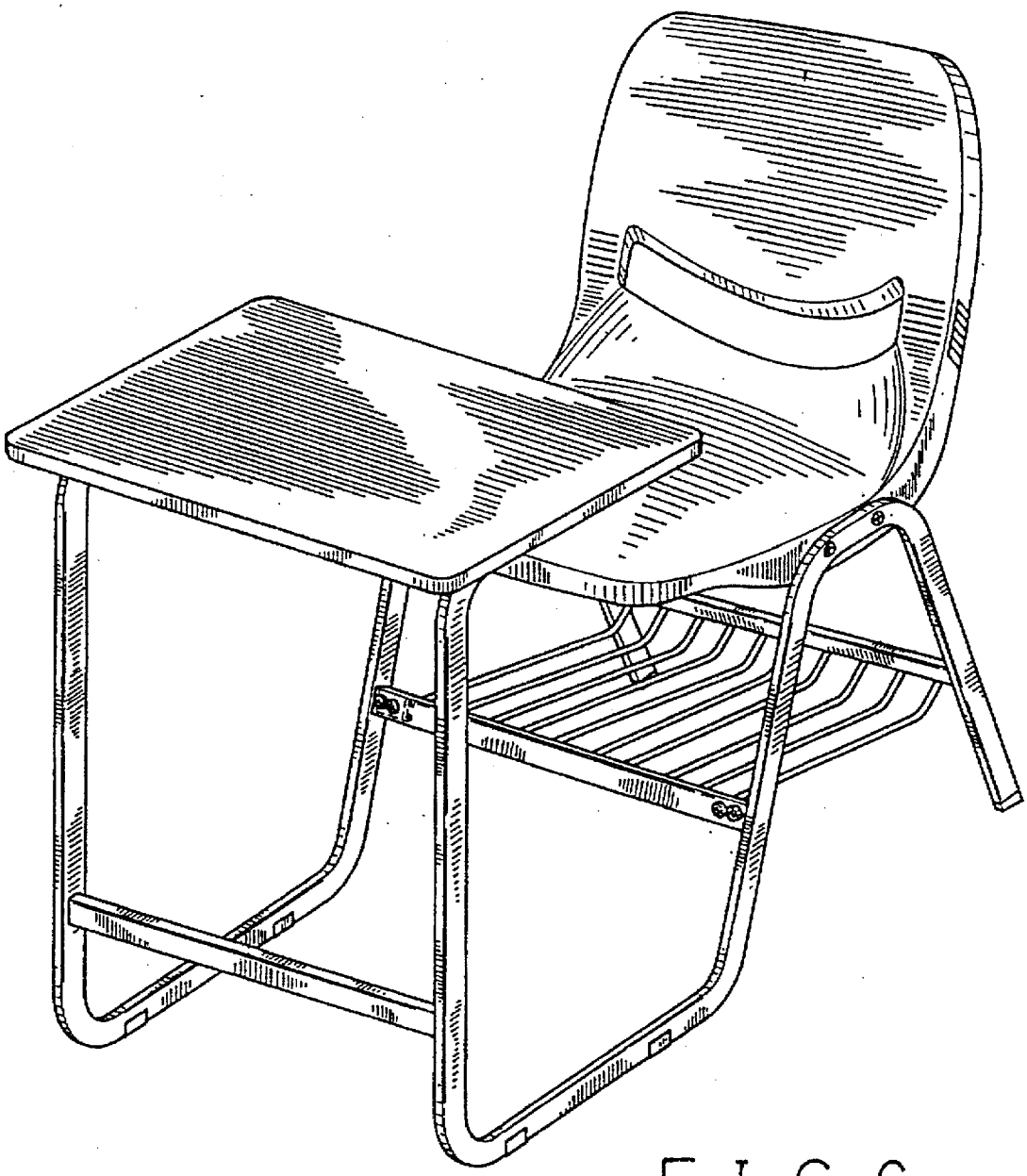
FIG. 6 is a solid view of a prior coupled desk chair.

In order to have a wider space selection, the middle member 11 is formed with an outer tube 116 and an inner tube 115 slidably received in the outer tube 116, as shown in FIG. 5. One end of the inner tube 115 is held by one outer tube 116, while the extending part of the inner tube 115 can slide in the other outer tube 116 freely, and on the second outer tube 116 there is a threaded hole for a bolt 117 bolting in to locate the inner tube 115 in order to control the inserted length of the inner tube 115, further to adjust the space between the tabletop 42 and the seat 52 to suit a bigger build.

I claim:

1. An adjustably coupled desk chair, comprising:

an H-shaped base frame having a longitudinally extended middle member, said middle member having an angularly directed socket formed therein adjacent a rear end thereof and a substantially vertically directed socket formed therein adjacent a front end thereof;

a seat support secured to said base frame within said angularly directed socket, said seat support being angularly directed rearwardly from said base frame;

a rear sliding thimble having opposing first and second ends, said first end being adjustably coupled to a distal end of said seat support in telescopic relationship therewith;

a first tie member having a first end affixed to said rear sliding thimble adjacent said second end thereof, said first tie member extending angularly in a direction substantially orthogonal said rear sliding member and having a second end coupled to a seat;

a tabletop support secured to said base frame within said substantially vertically directed socket, said tabletop support having a telescopic joint segment angularly directed forwardly from a distal end of a substantially vertically directed segment of said tabletop support;

a front sliding thimble having opposing first and second ends, said first end being adjustably coupled to said telescopic joint segment of said tabletop support in telescopic relationship therewith; and, a second tie member having a first end affixed to said front sliding thimble adjacent said second end thereof, said first tie member extending angularly in a direction substantially orthogonal said rear sliding member and having a second end coupled to a tabletop, wherein telescopic adjustment of said rear sliding thimble on said seat support provides substantial displacement of the seat both vertically and horizontally and telescopic adjustment of said front sliding thimble on said telescopic joint segment provides substantial displacement of the tabletop both vertically and horizontally, thereby providing adjustment of a relative vertical spacing between the tabletop and the seat and adjustment of a relative horizontal spacing therebetween.

* * * * *